US009488953B1

(12) United States Patent
Nakamura et al.

(10) Patent No.: US 9,488,953 B1
(45) Date of Patent: Nov. 8, 2016

(54) CLEANING BLADE, PROCESS CARTRIDGE, AND IMAGE FORMING APPARATUS

(71) Applicant: FUJI XEROX CO., LTD., Tokyo (JP)

(72) Inventors: Yu Nakamura, Kanagawa (JP); Daisuke Tano, Kanagawa (JP); Kei Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/045,375

(22) Filed: Feb. 17, 2016

(30) Foreign Application Priority Data

Sep. 7, 2015 (JP) ..... 2015-176029

(51) Int. Cl.
*G03G 21/00* (2006.01)

(52) U.S. Cl.
CPC ..... *G03G 21/0017* (2013.01); *G03G 21/0011* (2013.01)

(58) Field of Classification Search
CPC ..... G03G 21/0011; G03G 21/0017
USPC ..... 399/350
See application file for complete search history.

(56) References Cited

U.S. PATENT DOCUMENTS

2014/0255070 A1* 9/2014 Tano ..... G03G 21/0017 399/350
2015/0331384 A1* 11/2015 Kato ..... G03G 21/00 399/350

FOREIGN PATENT DOCUMENTS

JP 2014-235424 A 12/2014

* cited by examiner

*Primary Examiner* — Hoang Ngo
(74) *Attorney, Agent, or Firm* — Sughrue Mion, PLLC

(57) ABSTRACT

A cleaning blade includes a polyurethane member that contains a polyurethane, the polyurethane member constituting at least a contact portion that comes in contact with a member to be cleaned. An infrared absorption spectrum obtained by infrared spectroscopy of the polyurethane member has a peak intensity ratio (A/B) of about 1.1 or more, where A represents an intensity of a spectral peak due to a carbonyl group that does not form a hydrogen bond, the spectral peak appearing in a range of about 1,730 $cm^{-1}$ or more and about 1,740 $cm^{-1}$ or less, and B represents an intensity of a spectral peak due to a carbonyl group that forms a hydrogen bond, the spectral peak appearing in a range of about 1,670 $cm^{-1}$ or more and about 1,720 $cm^{-1}$ or less.

10 Claims, 6 Drawing Sheets

CLEANING BLADE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2015-176029 filed Sep. 7, 2015.

BACKGROUND (i) Technical Field

The present invention relates to a cleaning blade, a process cartridge, and an image forming apparatus.

(ii) Related Art

Hitherto, in copying machines, printers, facsimiles, etc. using an electrophotographic system, a cleaning blade has been used as a cleaning tool for cleaning a surface of a member to be cleaned, such as an image-carrying member, by removing a remaining toner and the like.

SUMMARY

According to an aspect of the invention, there is provided a cleaning blade including a polyurethane member that contains a polyurethane, the polyurethane member constituting at least a contact portion that comes in contact with a member to be cleaned, in which an infrared absorption spectrum obtained by infrared spectroscopy of the polyurethane member has a peak intensity ratio (A/B) of about 1.1 or more, where A represents an intensity of a spectral peak due to a carbonyl group that does not form a hydrogen bond, the spectral peak appearing in a range of about 1,730 $cm^{-1}$ or more and about 1,740 $cm^{-1}$ or less, and B represents an intensity of a spectral peak due to a carbonyl group that forms a hydrogen bond, the spectral peak appearing in a range of about 1,670 $cm^{-1}$ or more and about 1,720 $cm^{-1}$ or less.

BRIEF DESCRIPTION OF THE DRAWINGS

Exemplary embodiments of the present invention will be described in detail based on the following figures, wherein.

DETAILED DESCRIPTION

Figure 1:
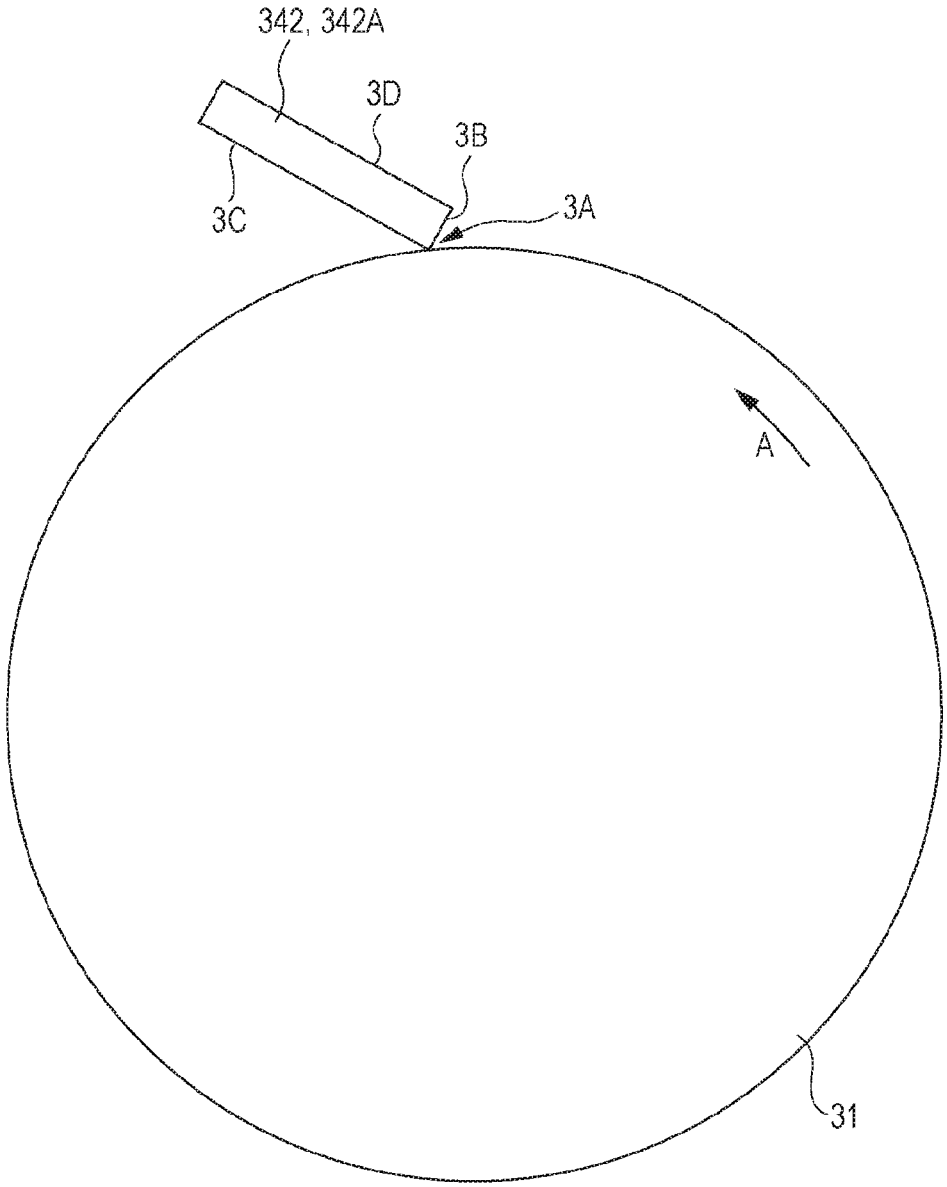
FIG. 1 is a schematic view illustrating an example of a cleaning blade according to an exemplary embodiment.

A cleaning blade, a cleaning device, a process cartridge, and an image forming apparatus according to exemplary embodiments of the invention will now be described in detail.

Cleaning Blade

A cleaning blade according to an exemplary embodiment includes a polyurethane member that contains a polyurethane, the polyurethane member constituting at least a contact portion that comes in contact with a member to be cleaned.

An infrared absorption spectrum obtained by infrared spectroscopy of the polyurethane member has a peak intensity ratio (A/B) of 1.1 or more or about 1.1 or more, where A represents an intensity of a spectral peak due to a carbonyl group that does not form a hydrogen bond, the spectral peak appearing in a range of 1,730 $cm^{-1}$ or more and 1,740 $cm^{-1}$ or less, or in a range of about 1,730 $cm^{-1}$ or more and about 1,740 $cm^{-1}$ or less, and B represents an intensity of a spectral peak due to a carbonyl group that forms a hydrogen bond, the spectral peak appearing in a range of 1,670 $cm^{-1}$ or more and 1,720 $cm^{-1}$ or less, or in a range of about 1,670 $cm^{-1}$ or more and about 1,720 $cm^{-1}$ or less.

Hitherto, in electrophotographic image forming apparatuses such as a copying machine, a printer, and a facsimile, a cleaning blade has been used as a cleaning tool for removing foreign substances such as a toner remaining on a surface of an image-carrying member. Since the cleaning blade is usually brought into contact with a member to be cleaned, such as an image-carrying member, for a long time, permanent deformation may occur in a portion that comes in contact with the member to be cleaned. This permanent deformation occurs more significantly with an increase in the temperature of the environment. When permanent deformation occurs in the cleaning blade, a pressure for pressing the member to be cleaned changes and is out of a desired range of the pressing pressure. As a result, foreign substances such as a remaining toner and an external additive easily pass through a gap between the member to be cleaned and the cleaning blade.

In particular, in electrophotographic image forming apparatuses that use a toner, the reduction in a toner size and the realization of a spherical toner have been desired in recent years. Accordingly, the passing through of a remaining toner may occur more easily in a contact portion between a member to be cleaned and a cleaning blade. The occurrence of the passing through of foreign substances such as a remaining toner and an external additive may result in streak-like image defects in an image forming apparatus.

Therefore, a reduction of this permanent deformation has been desired. That is, a property that the shape of a cleaning blade is retained even after a cleaning operation is repeatedly performed while the cleaning blade is pressed onto a member to be cleaned (shape-retaining property) has been desired.

In view of this, the cleaning blade according to the exemplary embodiment includes a polyurethane member whose infrared absorption spectrum obtained by infrared spectroscopy has a peak intensity ratio (A/B) of 1.1 or more or about 1.1 or more, where A represents an intensity of a spectral peak due to a carbonyl group that does not form a hydrogen bond, the spectral peak appearing in a range of 1,730 $cm^{-1}$ or more and 1,740 $cm^{-1}$ or less, or in a range of about 1,730 $cm^{-1}$ or more and about 1,740 $cm^{-1}$ or less, and B represents an intensity of a spectral peak due to a carbonyl group that forms a hydrogen bond, the spectral peak appearing in a range of 1,670 $cm^{-1}$ or more and 1,720 $cm^{-1}$ or less, or in a range of about 1,670 $cm^{-1}$ or more and about 1,720 $cm^{-1}$ or less. Accordingly, the cleaning blade according to the exemplary embodiment has a good shape-retaining property even after being repeatedly used in a cleaning operation compared with a case where the peak intensity ratio (A/B) is lower than the above range.

The reason why this effect is achieved is not clear but is believed to be as follows.

The peak intensity A is an indicator of an amount of carbonyl groups that do not form hydrogen bonds. The peak intensity B is an indicator of an amount of carbonyl groups that form hydrogen bonds. Accordingly, a peak intensity (A/B) of 1.1 or more or about 1.1 or more means that, regarding carbonyl groups in the polyurethane member, the amount of carbonyl groups that do not form hydrogen bonds is larger than the amount of carbonyl groups that form hydrogen bonds by 1.1 times or more or about 1.1 times or more.

Herein, the polyurethane contains a hard segment and a soft segment in the molecular structure thereof. The hard segment and the soft segment form a sea-island structure in which the hard segment forms domains and the domains are dispersed in the soft segment. The polyurethane includes a urethane bond (—NH—C(═O)—O—) in the molecular structure thereof. For example, a carbonyl group (—C(═O)—) in a urethane bond is hydrogen-bonded to —NH— or the like in another urethane bond, thereby producing the above-described carbonyl group that forms a hydrogen bond. In this portion of the carbonyl group that forms a hydrogen bond, urethane bonds are attracted to each other due to the hydrogen bond. As a result, the hard segment gathers and aggregates, and an aggregation diameter of the hard segment, that is, a particle size of a domain, increases.

However, according to the exemplary embodiment, regarding carbonyl groups in the polyurethane member, the amount of carbonyl groups that do not form hydrogen bonds is larger than the amount of carbonyl groups that form hydrogen bonds by 1.1 times or more or about 1.1 times or more. Accordingly, it is believed that the aggregation of the hard segment due to a hydrogen bond is suppressed, and the particle size of the domain is decreased compared with a case where the peak intensity ratio (A/B) is lower than the above range. As a result of the decrease in the domain particle size, molecular mobility becomes active, and plastic deformation of the polyurethane member is reduced. Consequently, permanent deformation may be reduced, and a good shape-retaining property may be obtained.

From the viewpoint of a long lifetime, good abrasion resistance has also been desired for a cleaning blade. Furthermore, when a stress is locally applied to a portion of the cleaning blade that comes in contact with a member to be cleaned, partial chipping of the cleaning blade may occur. In the portion where the chipping has occurred, cleaning is not satisfactorily performed, and thus chipping resistance against a local stress has also been desired.

In general, in a contact portion of a cleaning blade formed of a polyurethane member, when molecular mobility of the polyurethane member is increased, low-temperature characteristics improve, the glass transition temperature decreases, and chipping resistance improves. However, with an increase in the molecular mobility, the hardness decreases and thus the abrasion resistance decreases. That is, the chipping resistance and the abrasion resistance are in the relationship of trade-off.

In contrast, in the cleaning blade according to the exemplary embodiment, since the peak intensity ratio (A/B) is 1.1 or more or about 1.1 or more, both the chipping resistance and the abrasion resistance are realized.

The reason why this effect is achieved is not clear but is believed to be as follows.

The polyurethane member contains a hard segment and a soft segment in the molecular structure thereof. It is believed that a harder segment contributes to the hardness, that is, contributes to abrasion resistance. On the other hand, it is believed that a softer segment contributes to molecular mobility, that is, contributes to chipping resistance. When the hard segment aggregates and the particle size of the domain increases, the entire surface area of the hard segment decreases, and chipping tends to occur at an interface between the hard segment and the soft segment.

However, in the exemplary embodiment, regarding carbonyl groups in the polyurethane member, the amount of carbonyl groups that do not form hydrogen bonds is larger than the amount of carbonyl groups that form hydrogen bonds by 1.1 times or more or about 1.1 times or more. Accordingly, the domain particle size is reduced compared with a case where the peak intensity ratio (A/B) is lower than the above range, and thus the occurrence of chipping at an interface between the hard segment and the soft segment is suppressed, and chipping resistance is obtained. Furthermore, the aggregation of the hard segment may be controlled by changing the ratio of carbonyl groups that do not form hydrogen bonds to carbonyl groups that form hydrogen bonds without changing the amount of the hard segment. Accordingly, a change in the hardness is reduced, that is, the abrasion resistance is satisfactorily maintained.

Peak Intensity Ratio (A/B)

An infrared absorption spectrum obtained by infrared spectroscopy of the polyurethane member according to the present exemplary embodiment has a peak intensity ratio (A/B) of 1.1 or more or about 1.1 or more, where A represents an intensity of a spectral peak due to a carbonyl group that does not form a hydrogen bond, the spectral peak appearing in a range of 1,730 $cm^{-1}$ or more and 1,740 $cm^{-1}$ or less, or in a range of about 1,730 $cm^{-1}$ or more and about 1,740 $cm^{-1}$ or less, and B represents an intensity of a spectral peak due to a carbonyl group that forms a hydrogen bond, the spectral peak appearing in a range of 1,670 $cm^{-1}$ or more and 1,720 $cm^{-1}$ or less, or in a range of about 1,670 $cm^{-1}$ or more and about 1,720 $cm^{-1}$ or less. The peak intensity ratio (A/B) is more preferably 1.15 or more or about 1.15 or more, and still more preferably 1.2 or more or about 1.2 or more.

The upper limit of the peak intensity ratio (A/B) is not particularly limited. However, from the viewpoint of the ease of production, the peak intensity ratio (A/B) is preferably 1.3 or less or about 1.3 or less.

The infrared absorption spectrum is measured with a Frontier FT-IR Spectrometer (Fourier-transform infrared spectrometer) manufactured by PerkinElmer Co., Ltd.

The intensity A of a spectral peak due to a carbonyl group that does not form a hydrogen bond, the spectral peak appearing in a range of 1,730 $cm^{-1}$ or more and 1,740 $cm^{-1}$ or less, or in a range of about 1,730 $cm^{-1}$ or more and about 1,740 $cm^{-1}$ or less, and the intensity B of a spectral peak due to a carbonyl group that forms a hydrogen bond, the spectral peak appearing in a range of 1,670 $cm^{-1}$ or more and 1,720 $cm^{-1}$ or less, or in a range of about 1,670 $cm^{-1}$ or more and about 1,720 $cm^{-1}$ or less are specifically measured as follows.

The measurement is performed while a universal ATR accessory is attached to a PerkinElmer Frontier FT-IR Spectrometer. First, contaminants of a crystal of the ATR accessory are removed, and a measurement of the background (air) is performed. Subsequently, a sample is pressure-bonded to the crystal using a pressing jig, and a force gauge at this time is adjusted to 30. The obtained data is subjected to an ATR correction and a baseline correction and is normalized by a value of transmittance at 1,600 $cm^{-1}$.

The peak intensity ratio (A/B) in the polyurethane member may be controlled to the above range by adjusting the ratio of hydrogen bonds in carbonyl groups contained in the molecular structure of the polyurethane. The method for adjusting the ratio is not particularly limited. For example, with a decrease in the speed of the progress of the urethane bond formation during polymerization of a polyurethane, the ratio of carbonyl groups that do not form hydrogen bonds relative to all carbonyl groups tends to be high.

The speed of the progress of the urethane bond formation during polymerization of a polyurethane is controlled by adjusting the types and the composition ratio of a polyol, an isocyanate, a chain-extending agent, a crosslinking agent, etc. that are used as raw materials of the polyurethane. The speed of the progress of the urethane bond formation is also controlled by adjusting the reaction temperature and the reaction time or by appropriately selecting a forming method (for example, a centrifugal molding method or a cast press method) when polymerization and curing are performed.

tan δ Peak Temperature

A peak temperature of tan δ (loss tangent) in the polyurethane member is preferably 5° C. or less or about 5° C. or less, more preferably −30° C. or more and 5° C. or less or about −30° C. or more and about 5° C. or less, still more preferably −25° C. or more and 2° C. or less or about −25° C. or more and about 2° C. or less, and particularly preferably −20° C. or more and 0° C. or less or about −20° C. or more and about 0° C. or less.

When the tan δ peak temperature is 5° C. or less or about 5° C. or less, a polyurethane member having good low-temperature characteristics and good chipping resistance is obtained. When the tan δ peak temperature is −30° C. or more or about −30° C. or more, the tan δ at room temperature (20° C.) is not excessively low, and the polyurethane member advantageously maintains moderate impact resilience and does not excessively vibrate.

Herein, the tan δ peak temperature is derived from a storage modulus and a loss modulus described below. In the case where a sine-wave distortion is applied to a linear elastic body in a stationary vibration manner, the stress is represented by a formula (A) below. Here, |E*| is referred to as a "complex modulus". On the basis of the theory of rheology, an elastic component is represented by a formula (B) below, and a viscous component is represented by a formula (C) below. Here, E' is referred to as a "storage modulus", and E" is referred to as a "loss modulus". The symbol δ represents a phase difference angle between a stress and a strain and is referred to as a "mechanical loss angle". The value of tan δ is represented by E"/E' as represented by a formula (D) below and is referred to as a "loss tangent". The larger the value of tan δ, the higher the rubber elasticity of the linear elastic body.

$$\sigma=|E^*|\gamma\cos(\omega t) \quad \text{Formula (A):}$$

$$E'=|E^*|\cos\delta \quad \text{Formula (B):}$$

$$E''=|E^*|\sin\delta \quad \text{Formula (C):}$$

$$\tan\delta=E''/E' \quad \text{Formula (D):}$$

The value of tan δ is measured by using a Rheospectoler DVE-V4 (manufactured by Rheology Co., Ltd.) at a static strain of 5% with a 10 Hz sine-wave tensile vibration in a temperature range of −60° C. or more and 100° C. or less.

The tan δ peak temperature in the polyurethane member is controlled by, for example, adjusting the peak intensity ratio (A/B). The tan δ peak temperature tends to be decreased by increasing the peak intensity ratio (A/B). The tan δ peak temperature tends to be increased by decreasing the molecular weight of a polyol. The tan δ peak temperature tends to be increased by increasing the amount of crosslinking agent. However, the method for adjusting the tan δ peak temperature is not limited to the methods described above.

The structure of a cleaning blade according to the present exemplary embodiment will now be described in detail.

Figure 2:
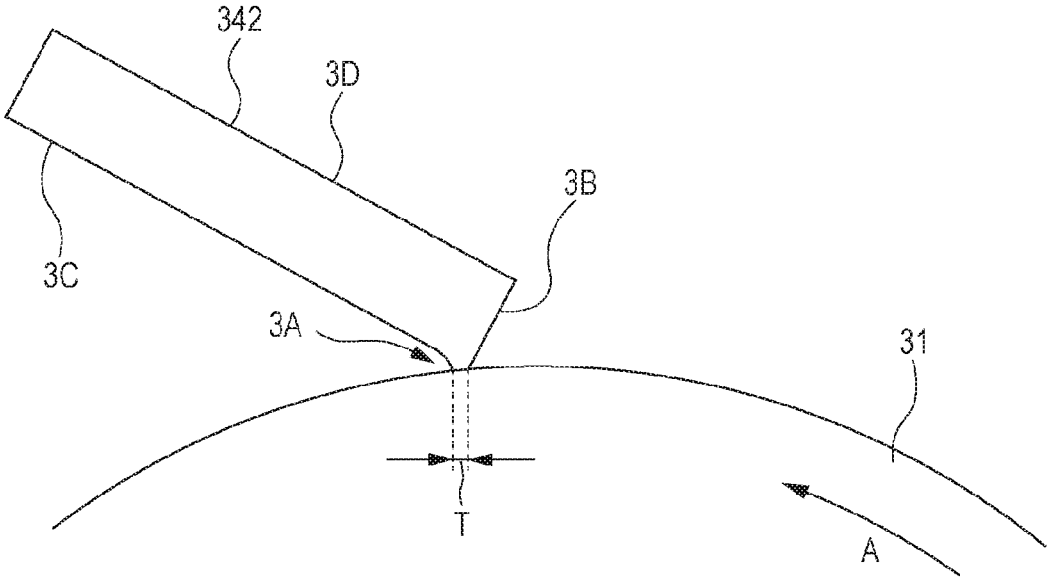
FIG. 2 is a schematic view illustrating a state in which a cleaning blade according to an exemplary embodiment is in contact with an image-carrying member which is driving.

As illustrated in FIG. 1, the cleaning blade according to the exemplary embodiment is arranged to be in contact with a surface of a member 31 to be cleaned. When the member 31 to be cleaned is driven, as illustrated in FIG. 2, sliding occurs in a contact portion where a cleaning blade 342 is in contact with the member 31 to be cleaned, and a nip part T is formed. Thus, the surface of the member 31 to be cleaned is cleaned.

Respective portions of the cleaning blade will now be described with reference to the drawings. In the description below, as illustrated in FIG. 1, the cleaning blade includes a contact corner portion 3A, an end surface 3B, a front surface 3C, and a back surface 3D. The contact corner portion 3A comes in contact with the member (image-carrying member, i.e., photoreceptor drum) 31 that is driven and that is to be cleaned and cleans the surface of the member (image-carrying member) 31 to be cleaned. The end surface 3B, one edge of which is formed by the contact corner portion 3A, faces the upstream side of a direction in which the member 31 is driven (direction shown by the arrow A). The front surface 3C, one edge of which is formed by the contact corner portion 3A, faces the downstream side of the direction in which the member 31 is driven (direction shown by the arrow A). The back surface 3D, one edge of which is shared with the end surface 3B, faces the front surface 3C.

A direction parallel to a direction in which the contact corner portion 3A comes in contact with the member 31 to be cleaned (direction from the front surface to the back surface of the paper of FIG. 1) is referred to as a "longitudinal direction". A direction extending from the contact corner portion 3A to the side on which the end surface 3B is formed is referred to as a "thickness direction". A direction extending from the contact corner portion 3A to the side on which the front surface 3C is formed is referred to as a "width direction".

In FIG. 1, for the sake of convenience, the direction in which the image-carrying member (photoreceptor drum) 31 is driven is shown by the arrow A. However, FIG. 1 illustrates a state where the image-carrying member 31 is stopped.

Figure 5:
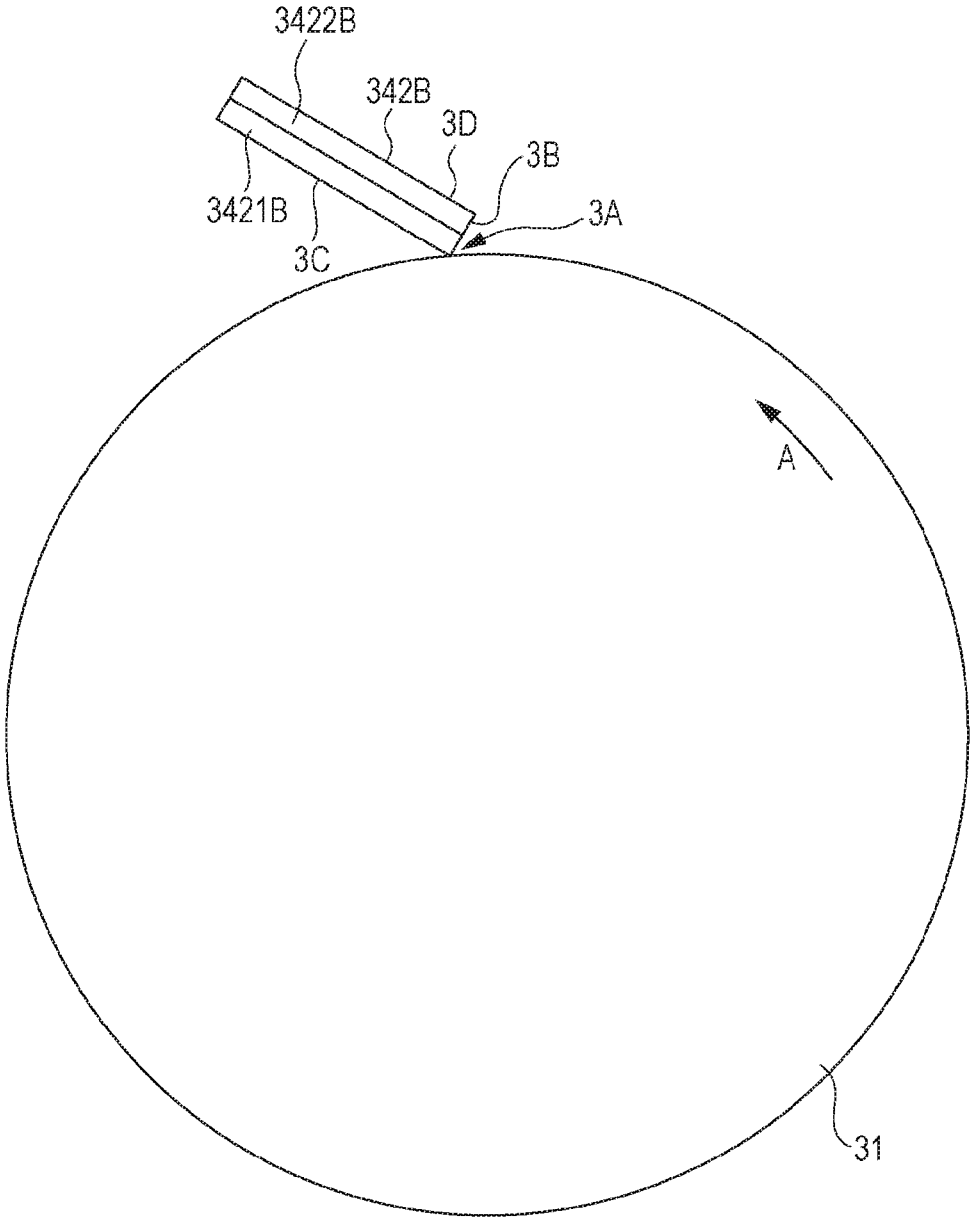
FIG. 5 is a schematic view illustrating another example of a cleaning blade according to an exemplary embodiment.
Figure 6:
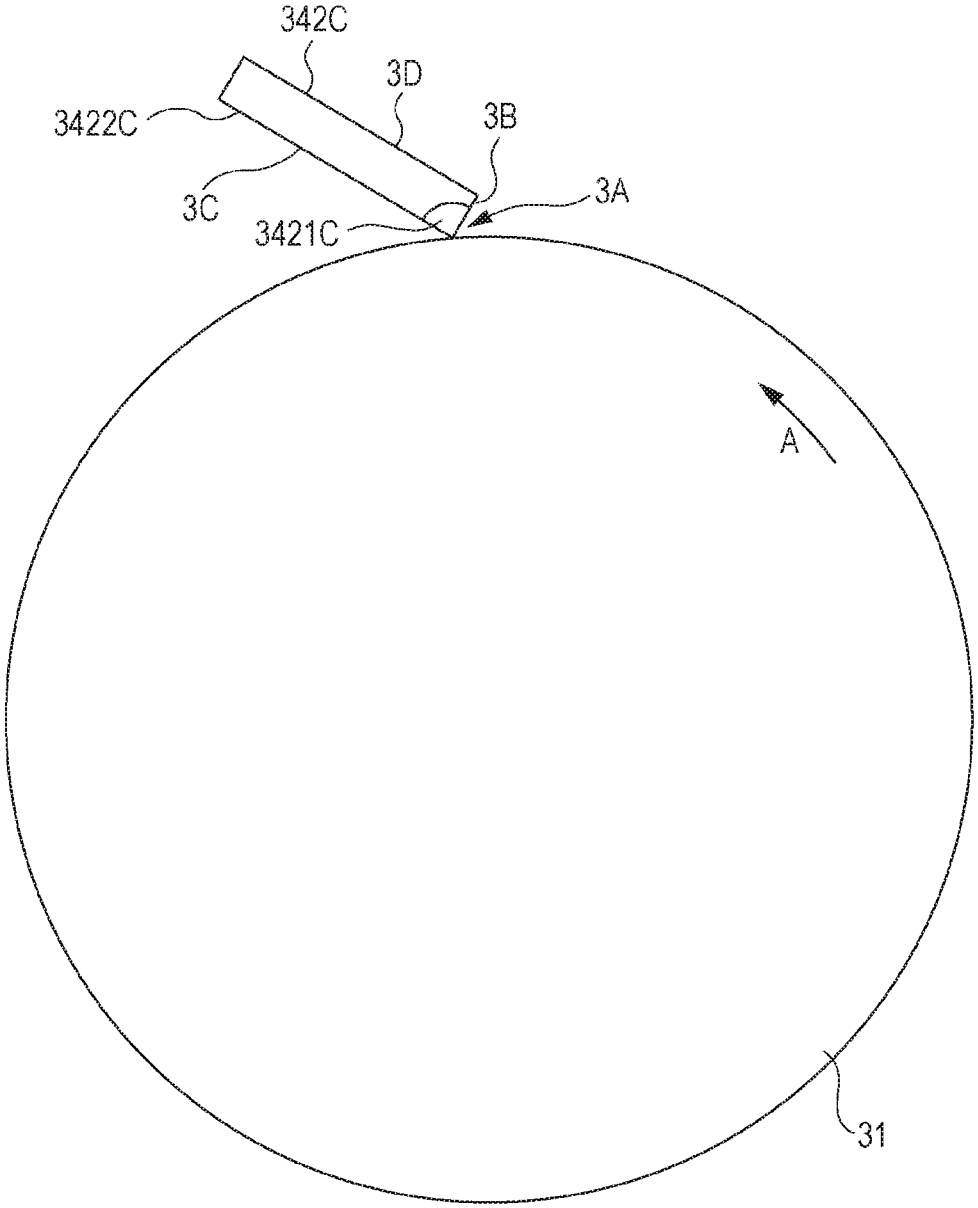
FIG. 6 is a schematic view illustrating another example of a cleaning blade according to an exemplary embodiment.

FIG. 1 is a schematic view illustrating a cleaning blade according to a first exemplary embodiment, and illustrates a state where the cleaning blade is in contact with a surface of a photoreceptor drum, which is an example of a member to be cleaned. FIG. 5 is a schematic view illustrating a state where a cleaning blade according to a second exemplary embodiment is in contact with a surface of a photoreceptor drum. FIG. 6 is a schematic view illustrating a state where a cleaning blade according to a third exemplary embodiment is in contact with a surface of a photoreceptor drum.

A cleaning blade 342A according to the first exemplary embodiment illustrated in FIG. 1 includes a polyurethane member alone. Specifically, the whole of the cleaning blade 342A including a portion (contact corner portion 3A) that comes in contact with a photoreceptor drum 31 is formed of a single material.

The cleaning blade according to the exemplary embodiment may have a two-layer structure as in the second exemplary embodiment illustrated in FIG. 5. Specifically, the cleaning blade may include a first layer 3421B and a second layer 3422B. The first layer 3421B includes a portion (contact corner portion 3A) which comes in contact with the photoreceptor drum 31, is formed over the entire surface on the front surface 3C side, and is formed of a polyurethane member. The second layer 3422B is formed on the back surface 3D side relative to the first layer 3421B, and functions as a back surface layer formed of a material different from a material of the polyurethane member.

The cleaning blade of the exemplary embodiment may have a structure as in the third exemplary embodiment illustrated in FIG. 6. Specifically, the cleaning blade may include a contact member (edge member) 3421C formed of a polyurethane member and a back surface member 3422C formed of a material different from a material of the polyurethane member. The contact member 3421C includes a portion (i.e., contact corner portion 3A) which comes in contact with the photoreceptor drum 31. The contact member 3421C has a shape in which a quarter-circle column extends in the longitudinal direction, and a right-angle portion of the shape forms the contact corner portion 3A of the contact member. The back surface member 3422C covers a portion on the back surface 3D side of the contact member 3421C in the thickness direction and a portion on the side opposite to the end surface 3B of the contact member 3421C in the width direction. That is, the back surface member 3422C constitutes a portion other than the contact member 3421C.

FIG. 6 illustrates, as the contact member, an example of a member having a shape of a quarter-circle column. However, the shape of the contact member is not limited thereto. Alternatively, the contact member may have a shape of a quarter-ellipse column, a square-cross-section prism, a rectangular-cross-section prism, or the like.

(Polyurethane Member)

The polyurethane member in the cleaning blade according to the present exemplary embodiment contains a polyurethane (polyurethane rubber).

The polyurethane is usually synthesized by polymerizing a polyisocyanate and a polyol. Besides a polyol, a resin having a functional group that may react with an isocyanate group may be used. The polyurethane contains a hard segment and a soft segment.

Herein, the term "hard segment" refers to a segment formed of a material harder than a material constituting the soft segment in a resin, and the term "soft segment" refers to a segment formed of a material softer than a material constituting the hard segment in the resin.

The combination of the material constituting the hard segment (hard segment material) and the material constituting the soft segment (soft segment material) is not particularly limited. The hard segment material and the soft segment material may be selected from known resin materials so that a first material that is harder than a second material and the second material that is softer than the first material are used in combination.

Polyol

Examples of the polyol include polyester polyols (for example, polybutylene adipate) obtained by dehydration condensation of a diol and a dibasic acid, polycarbonate polyols obtained by a reaction between a diol and an alkyl carbonate, polycaprolactone polyols, and polyether polyols (for example, polytetramethylene ether glycol). Examples of commercially available products of the above polyols include PLACCEL 205, PLACCEL 240, and PLACCEL 260, all of which are manufactured by Daicel Corporation, NIPPOLAN 4009 manufactured by Tosoh Corporation, TESURAKKU 2464 manufactured by Hitachi Chemical Co., Ltd., and PTG-2000SN manufactured by Hodogaya Chemical Co., Ltd. These may be used alone or in combination of two or more polyols.

Examples of polyester polyols that may be used include polyester polyols obtained by dehydration condensation of a diol and a dibasic acid, polyester polyols obtained by ring-opening polymerization of a lactone (cyclic ester), and polyester polyols obtained by dehydration condensation of a dibasic acid and a polyol obtained by ring-opening polymerization of a lactone (cyclic ester).

Examples of the diol include ethylene glycol, propanediol, butanediol, pentanediol, hexanediol, heptanediol, octanediol, nonanediol, decanediol, undecanediol, dodecanediol, tridecanediol, tetradecanediol, octadecanediol, and eicosanediol. Examples of the dibasic acid include adipate (adipic acid), oxalic acid, malonic acid, succinic acid, glutaric acid, pimelic acid, suberic acid, azelaic acid, sebacic acid, nonanedicarboxylic acid, decanedicarboxylic acid, undecanedicarboxylic acid, dodecanedicarboxylic acid, tridecanedicarboxylic acid, tetradecanedicarboxylic acid, hexadecanedicarboxylic acid, octadecanedicarboxylic acid, and lower alkyl esters and acid anhydrides thereof.

Examples of the lactone (cyclic ester) include ϵ-caprolactone, trimethylcaprolactone, and valerolactone.

Polyols (such as 1,4-butanediol) cited in the section of "chain-extending agent" described below may be used as the polyol. Furthermore, these polyols may be used in combination with a dibasic acid. Examples of the dibasic acid include adipate (adipic acid) and sebacic acid.

Resin Having Functional Group that May React with Isocyanate Group

A resin having a functional group that may react with an isocyanate group may be used as a raw material of the polyurethane. The resin is preferably a resin having flexibility. From the viewpoint of flexibility, the resin is more preferably an aliphatic resin having a straight-chain structure. Specific examples of the resin include acrylic resins having two or more hydroxyl groups, polybutadiene resins having two or more hydroxyl groups, and epoxy resins having two or more epoxy groups.

Examples of commercially available products of the acrylic resins having two or more hydroxyl groups include ACTFLOW (grade: UMB-2005B, UMB-2005P, UMB-2005, UME-2005, etc.) manufactured by Soken Chemical & Engineering Co., Ltd.

An example of commercially available products of the polybutadiene resins having two or more hydroxyl groups is R-45HT manufactured by Idemitsu Kosan Co., Ltd.

The epoxy resins having two or more epoxy groups are not existing typical epoxy resins which are hard and brittle but are preferably epoxy resins which are more flexible and tougher than such existing epoxy resins. For example, from the viewpoint of the molecular structure, epoxy resins having a structure that may increase mobility of the main chain (flexible backbone) in the main chain structure thereof are suitable. Examples of the flexible backbone include alkylene backbones, cycloalkane backbones, and polyoxyalkylene backbones. In particular, polyoxyalkylene backbones are suitable.

From the viewpoint of physical properties, epoxy resins having a low viscosity relative to a molecular weight as compared with existing typical epoxy resins are suitable. Specifically, the weight-average molecular weight is preferably in the range of 900±100, and the viscosity at 25° C. is preferably in the range of 15,000±5,000 mPa·s and more preferably in the range of 15,000±3,000 mPa·s. An example of commercially available products of an epoxy resin having these characteristics is EPICLON EXA-4850-150 manufactured by DIC Corporation.

Polyisocyanate

A polyisocyanate is used in the synthesis of the polyurethane. Examples of the polyisocyanate include 4,4'-diphenylmethane diisocyanate (MDI), 2,6-toluene diisocyanate (TDI), hexamethylene diisocyanate (HDI), 1,5-naphthalene diisocyanate (NDI), and 3,3'-dimethylbiphenyl-4,4'-diisocyanate (TODI).

The polyisocyanate is preferably 4,4'-diphenylmethane diisocyanate (MDI), 1,5-naphthalene diisocyanate (NDI), and hexamethylene diisocyanate (HDI), and more preferably 4,4'-diphenylmethane diisocyanate (MDI).

The amount of polyisocyanate relative to 100 parts by weight of the resin having a functional group that may react with an isocyanate group of the polyisocyanate is preferably 20 parts by weight or more and 40 parts by weight or less, more preferably 20 parts by weight or more and 35 parts by weight or less, and still more preferably 20 parts by weight or more and 30 parts by weight or less. When the amount of polyisocyanate is 20 parts by weight or more, the urethane bond is ensured in a large amount and the hard segment is grown, and a desired hardness is obtained. When the amount of polyisocyanate is 40 parts by weight or less, the size of the hard segment does not excessively increase and expansibility is obtained, and thus the generation of chipping of the cleaning blade is suppressed.

Chain-Extending Agent

The polyurethane in the present exemplary embodiment may be a polymer in which a chain-extending agent is polymerized.

The chain-extending agent is not particularly limited, and known chain-extending agent may be used. Examples of the chain-extending agent include glycols such as ethylene glycol, 1,3-propanediol, 1,4-butanediol, 1,5-pentanediol, 1,6-hexanediol, 1,7-heptanediol, 1,8-octanediol, 1,9-nonanediol, diethylene glycol, and neopentyl glycol; trivalent or higher polyhydric alcohols such as diglycerin and pentaerythritol; and amino polyhydric alcohols such as diisopropanolamine, triisopropanolamine, and triethanolamine. Among these, glycols and trivalent alcohols are preferable, and glycols are more preferable.

Among glycols, 1,3-propanediol and 1,4-butanediol are more preferable.

The chain-extending agent is more preferably a straight-chain diol having 3 or more carbon atoms. The above compounds serving as the chain-extending agent may be used alone or in combination of two or more compounds.

Crosslinking Agent

The polyurethane in the present exemplary embodiment may be a polymer obtained by crosslinking polymerization with a crosslinking agent.

Examples of the crosslinking agent include diols (bifunctional crosslinking agents), triols (trifunctional crosslinking agents), and tetraols (tetrafunctional crosslinking agents). These may be used in combination. Alternatively, amine compounds may be used as the crosslinking agent. The polyurethane may be crosslinked by using a trifunctional or higher crosslinking agent. Examples of the trifunctional crosslinking agent include trimethylolpropane, glycerin, and triisopropanolamine.

The amount of crosslinking agent relative to 100 parts by weight of the resin having a functional group that may react with an isocyanate group is preferably 2 parts by weight or less. When the amount of crosslinking agent is 2 parts by weight or less, the hard segment derived from urethane bonds formed by aging is significantly grown without restriction of molecular motion due to chemical crosslinking, and thus a desired hardness is easily obtained.

Method for Forming Polyurethane Member (Contact Member)

In the production of a polyurethane constituting the polyurethane member (contact member) in the present exemplary embodiment, a typical method for producing a polyurethane, such as a prepolymer method or a one-shot method, is employed. The prepolymer method is suitable for the present exemplary embodiment because a polyurethane having high strength and good abrasion resistance is obtained. However, the polyurethane is not limited by the production method.

The polyurethane is produced by mixing a polyisocyanate, a chain-extending agent, a crosslinking agent, etc. with the polyol described above, and forming the resulting composition.

The contact member of the cleaning blade is prepared by, for example, forming a composition for forming a polyurethane member (contact member), the composition being prepared by the above method, into a sheet by using centrifugal molding, extrusion molding, or the like, and performing a cutting process or the like.

For example, a composition for forming a polyurethane member (contact member) is poured into a mold of a centrifugal molding machine, and is subjected to a curing reaction. The mold temperature at this time is preferably 80° C. or more and 160° C. or less, and more preferably 100° C. or more and 140° C. or less. The reaction time is preferably 20 minutes or more and 3 hours or less, and more preferably 30 minutes or more and 2 hour or less.

The resulting cured product is further heated for aging and cooled. The temperature during this heating for aging is preferably 70° C. or more and 130° C. or less, more preferably 80° C. or more and 130° C. or less, and still more preferably 100° C. or more and 120° C. or less. The reaction time is preferably 1 hour or more and 48 hours or less, and more preferably 10 hours or more and 24 hours or less.

100% Modulus (Stress at a Given Elongation)

The polyurethane member preferably has a 100% modulus of 6 MPa or more, more preferably 7 MPa or more, and still more preferably 7.5 MPa or more. Regarding the upper limit of the 100% modulus, the 100% modulus is preferably 11 MPa or less, and more preferably 10 MPa or less.

When the 100% modulus is 6 MPa or more, the polyurethane member has an appropriate hardness and good abrasion resistance.

Herein, the 100% modulus is a value measured in accordance with JIS K6251 (2004). Specifically, the measurement is performed using a dumbbell-shaped No. 3 test piece at a tensile speed of 500 mm/min to obtain a stress-strain curve (environmental temperature: 23° C.), and the 100% modulus is determined on the basis of this curve. A Strograph AE Elastomer manufactured by Toyo Seiki Seisaku-sho, Ltd. is used as a measurement device.

(Non-Contact Member)

A description will be made of a composition of a non-contact member in the case where the cleaning blade of the exemplary embodiment has a structure in which a contact member and a region other than the contact member (non-contact member) are formed of different materials, as in the exemplary embodiment illustrated in FIG. 5 or the exemplary embodiment illustrated in FIG. 6.

The material of the non-contact member in the cleaning blade according to the exemplary embodiment is not particularly limited, and any known material may be used.

Examples of the material used as the non-contact member include polyurethanes, silicone rubber, fluororubber, chloroprene rubber, and butadiene rubber. Among these materials, polyurethanes are preferable. Examples of the polyurethanes include ester-based polyurethanes and ether-based polyurethanes. In particular, ester-based polyurethanes are preferable.

An example of a method for producing a polyurethane is a method using a polyol and a polyisocyanate.

Examples of the polyol include polyols described in the section of the polyurethane member. Specific examples of the polyol include polytetramethylene ether glycol, polyethylene adipate, and polycaprolactone.

Examples of the polyisocyanate include polyisocyanates described in the section of the polyurethane member. Specific examples of the polyisocyanate include 2,6-toluene diisocyanate (TDI), 4,4'-diphenylmethane diisocyanate (MDI), para-phenylene diisocyanate (PPDI), 1,5-naphthalene diisocyanate (NDI), and 3,3'-dimethylbiphenyl-4,4'-diisocyanate (TODI). Among these polyisocyanates, MDI is preferable.

Furthermore, examples of a curing agent for curing the polyurethane include 1,4-butanediol, trimethylolpropane, ethylene glycol, and mixtures thereof.

A specific example will be described. 4,4'-Diphenylmethane diisocyanate is mixed with polytetramethylene ether glycol which has been subjected to a dehydration treatment, and the resulting mixture is allowed to react to produce a prepolymer. 1,4-Butanediol and trimethylolpropane may be used in combination as a curing agent and added to the prepolymer. An additive such as a reaction-controlling agent may be added thereto.

A known method is employed as a method for preparing the non-contact member in accordance with the raw material used in the preparation. The non-contact member is prepared by, for example, forming the material by centrifugal molding, extrusion molding, or the like, and performing a cutting process or the like so as to have a predetermined shape.

(Production of Cleaning Blade)

In the case where a cleaning blade includes only the contact member illustrated in FIG. 1, the cleaning blade is produced by the above-described method for forming the contact member.

In the case where a cleaning blade has a multilayer structure, for example, the two-layer structure illustrated in FIG. 5, the cleaning blade is produced by bonding a first layer functioning as a contact member and a second layer (plural layers in the case of a structure including three or more layers) functioning as a non-contact member to each other. In the method for bonding the layers to each other, a double-sided tape, an adhesive, or the like is suitably used. Alternatively, plural layers may be bonded to each other by pouring materials of respective layers into a mold at time intervals during molding, thus joining the molded materials to each other without providing an adhesive layer.

In the case where a cleaning blade includes a contact member (edge member) and a non-contact member (back surface member) as illustrated in FIG. 6, the cleaning blade is produced as follows. A first mold and a second mold are prepared. The first mold has a cavity (i.e., a region into which a composition for forming a contact member is poured) corresponding to a semicircular column shape formed by arranging two contact members 3421C illustrated in FIG. 6 so that the front surfaces 3C of the contact members 3421C are in contact with each other. The second mold has a cavity corresponding to a shape formed by arranging two contact members 3421C and two non-contact members 3422C so that the front surfaces 3C of the contact members 3421C are in contact with each other and the front surfaces 3C of the non-contact members 3422C are in contact with each other. A composition for forming a contact member is poured into the cavity of the first mold and then cured to form a first molded body having a shape in which the two contact members 3421C are in contact with each other. Next, the first mold is detached. Subsequently, the second mold is disposed so that the first molded body is arranged inside the cavity of the second mold. A composition for forming a non-contact member is then poured into the cavity of the second mold so as to cover the first molded body and cured to form a second molded body having a shape in which the two contact members 3421C and the two non-contact members 3422C are arranged so that the front surfaces 3C of the contact members 3421C are in contact with each other and the front surfaces 3C of the non-contact members 3422C are in contact with each other. Subsequently, the resulting second molded body is cut at the center, that is, in a portion which is to form the front surface 3C. Specifically, the second molded body is cut such that the contact member having a semicircular column shape is separated at the center and each of the separated molded bodies has a shape of a quarter-circle column. The resulting molded body is further cut so as to have predetermined dimensions. Thus, the cleaning blade illustrated in FIG. 6 is produced.

Applications

In the case where a member to be cleaned is cleaned by using the cleaning blade of the exemplary embodiment, the member to be cleaned, which is a target of cleaning, is not particularly limited as long as cleaning of a surface of the member is required. For example, in the case where the cleaning blade is used in an image forming apparatus, examples of the member to be cleaned include an intermediate transfer body, a charging roller, a transfer roller, a transfer material-transporting belt, a paper transport roller, and a detoning roller that further removes a toner from a cleaning brush for removing the toner from an image-carrying member. In the exemplary embodiment, the member to be cleaned may be an image-carrying member.

Cleaning Device, Process Cartridge, and Image Forming Apparatus

A cleaning device, a process cartridge, and an image forming apparatus that include the cleaning blade of the present exemplary embodiment will be described.

The cleaning device of the exemplary embodiment is not particularly limited as long as the cleaning blade of the exemplary embodiment is provided as a cleaning blade that comes in contact with a surface of a member to be cleaned and that cleans the surface of the member. The cleaning device has, for example, the following structure. In a cleaning case having an opening adjacent to a member to be cleaned, a cleaning blade is fixed so that an end of an edge thereof is located on the opening side. The cleaning device includes a transport member that leads foreign substances such as a waste toner and the like to a foreign substance-collecting container, the waste toner and the like being collected by the cleaning blade from a surface of the member to be cleaned. The cleaning device of the exemplary embodiment may include two or more cleaning blades of the exemplary embodiment.

In the case where the cleaning blade of the exemplary embodiment is used for cleaning an image-carrying member, in order to suppress image deletion during image formation, a force NF (normal force) at which the cleaning blade is pressed onto the image-carrying member is preferably in the range of 1.3 gf/mm or more and 2.3 gf/mm or less, and more preferably in the range of 1.6 gf/mm or more and 2.0 gf/mm or less.

A length of an end of the cleaning blade engaged in the image-carrying member is preferably in the range of 0.8 mm or more and 1.2 mm or less, and more preferably in the range of 0.9 mm or more and 1.1 mm or less.

An angle W/A (working angle) in the portion in which the cleaning blade comes in contact with the image-carrying member is preferably in the range of 8° or more and 14° or less, and more preferably in the range of 10° or more and 12° or less.

The process cartridge of the exemplary embodiment is not particularly limited as long as the process cartridge includes the cleaning device of the exemplary embodiment as a cleaning device that comes in contact with a surface of at least one member to be cleaned, such as an image-carrying member and an intermediate transfer body, and that cleans the surface of the at least one member to be cleaned. For example, an exemplary embodiment of the process cartridge is detachably attachable to an image forming apparatus and includes an image-carrying member and the cleaning device of the exemplary embodiment that cleans the surface of the image-carrying member. For example, in the case of a so-called tandem machine that includes image-carrying members corresponding to toners of respective colors, the cleaning device of the exemplary embodiment may be provided for each of the image-carrying members. Besides the cleaning device of the exemplary embodiment, a cleaning brush and the like may be used in combination.

Specific Examples of Cleaning Blade, Image Forming Apparatus, and Cleaning Device Specific examples of the cleaning blade of the present exemplary embodiment, and an image forming apparatus and a cleaning device that include the cleaning blade will now be described in more detail with reference to the drawings.

Figure 3:
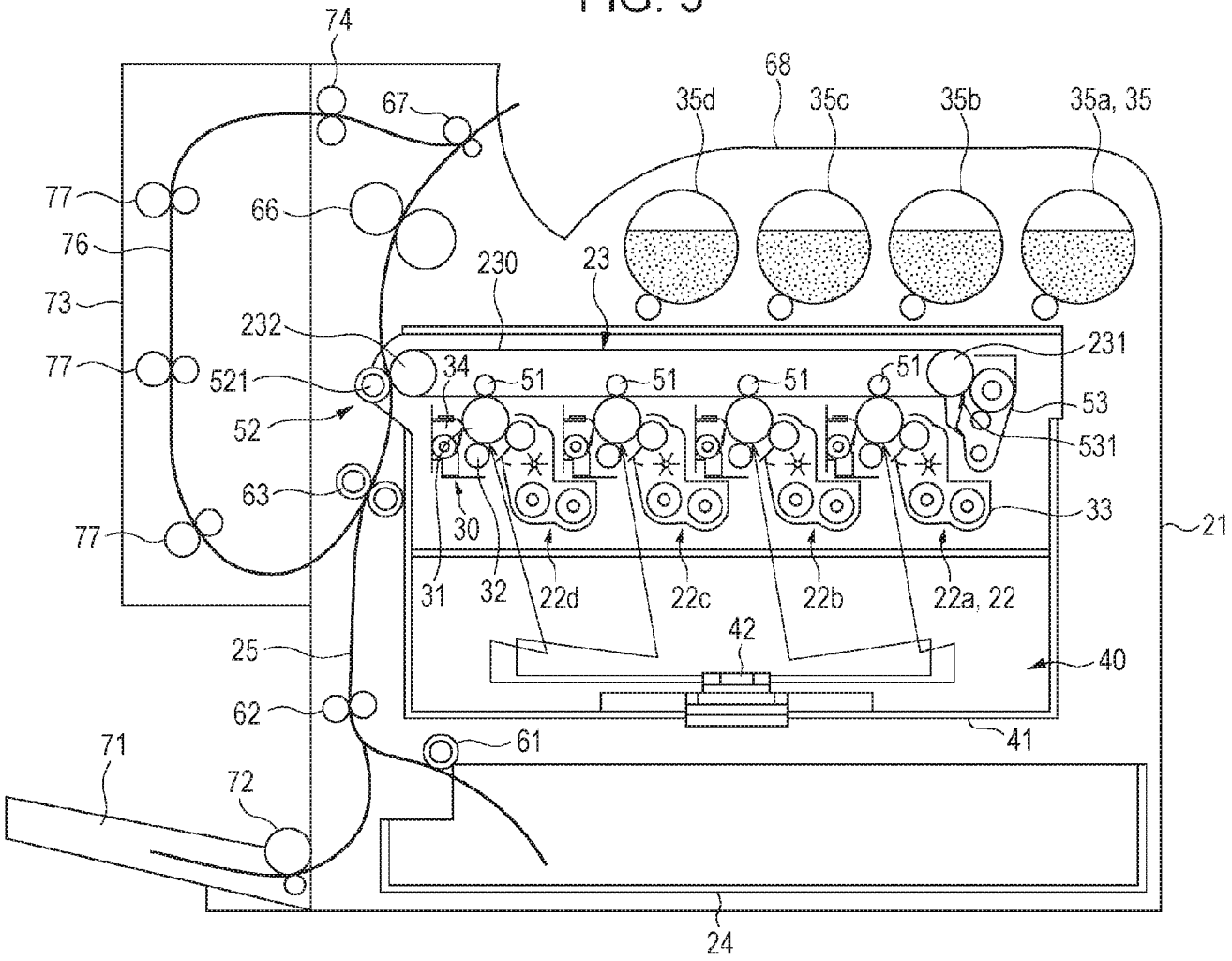
FIG. 3 is an overall schematic view illustrating an example of an image forming apparatus according to an exemplary embodiment.

FIG. 3 is an overall schematic view illustrating an example of an image forming apparatus according to the exemplary embodiment and illustrates a so-called tandem image forming apparatus.

The image forming apparatus illustrated in FIG. 3 includes a body housing 21, image forming units 22 (22*a* to 22*d*), a belt module 23, a recording medium supply cassette 24, a recording medium transport path 25, photoreceptor units 30, photoreceptor drums 31, charging rollers 32, developing units 33, cleaning devices 34, toner cartridges 35 (35*a* to 35*d*), an exposure unit 40, a unit case 41, a polygon mirror 42, first transfer devices 51, a second transfer device 52, a belt cleaning device 53, a feed roller 61, transport rollers 62, positioning rollers 63, a fixing device 66, discharge rollers 67, a paper discharge unit 68, a manual feeder 71, feed rollers 72, a double-side recording unit 73, guide rollers 74, a transport path 76, transport rollers 77, an intermediate transfer belt 230, support rollers 231 and 232, a second transfer roller 521, and a cleaning blade 531.

In the tandem image forming apparatus illustrated in FIG. 3, the image forming units 22 (specifically, 22*a* to 22*d*) of four colors (yellow, magenta, cyan, and black in this exemplary embodiment) are arranged in the body housing 21. Above the image forming units 22, the belt module 23 is arranged. The belt module 23 includes the intermediate transfer belt 230 which is transported in a circulating manner in a direction in which the image forming units 22 are arranged. In a lower portion of the body housing 21, the recording medium supply cassette 24 in which a recording medium (not illustrated) such as paper is housed is arranged, and the recording medium transport path 25, which serves as a transport path of the recording medium from the recording medium supply cassette 24, is arranged in the vertical direction.

In the exemplary embodiment, the image forming units 22 (22*a* to 22*d*) sequentially form toner images for yellow, magenta, cyan, and black (the arrangement of the image forming units 22 is not particularly limited to this order) from the upstream in a circulation direction of the intermediate transfer belt 230. The image forming units 22 (22*a* to 22*d*) each include a photoreceptor unit 30, a developing unit 33, and a common expose unit 40.

Each of the photoreceptor units 30 is produced by, for example, integrally arranging, as a sub-cartridge, a photoreceptor drum 31, a charging device (charging roller) 32 that charges the photoreceptor drum 31 in advance, and a cleaning device 34 that removes a toner remaining on the photoreceptor drum 31.

Each of the developing units 33 develops an electrostatic latent image, which is formed on the charged photoreceptor drum 31 by exposure with the exposure unit 40, with a corresponding color toner (for example, negative polarity in this exemplary embodiment). For example, each of the developing units 33 is integrated with the sub-cartridge including the photoreceptor unit 30 to form a process cartridge (so-called customer replaceable unit).

The photoreceptor unit 30 may be separated from the developing unit 33 and used alone as a process cartridge. In FIG. 3, the toner cartridges 35 (35*a* to 35*d*) supply respective color component toners to the corresponding developing units 33 (toner supply paths are not illustrated in the figure).

The exposure unit 40 includes, for example, four semiconductor lasers (not illustrated), the polygon mirror 42, imaging lenses (not illustrated), and mirrors (not illustrated) corresponding to the photoreceptor units 30 in the unit case 41. The exposure unit 40 is configured to deflect and scan light from the semiconductor laser for each color component by the polygon mirror 42 and to guide an optical image to an exposure point on the corresponding photoreceptor drum 31 through the imaging lens and the mirror.

In the exemplary embodiment, the belt module 23 includes, for example, a pair of the support rollers (one of which functions as a driving roller) 231 and 232, and the intermediate transfer belt 230 that is stretched between the support rollers 231 and 232. The first transfer devices (first transfer rollers in this exemplary embodiment) 51 are arranged at positions on the back surface of the intermediate transfer belt 230, the positions corresponding to the photoreceptor drums 31 of the respective photoreceptor units 30. By applying a voltage having a polarity opposite to the charging polarity of a toner to each of the first transfer devices 51, the toner image on the photoreceptor drum 31 is electrostatically transferred to the intermediate transfer belt 230. Furthermore, the second transfer device 52 is arranged in a portion corresponding to the support roller 232 on the downstream of the image forming unit 22*d* which is arranged on the most downstream side of the intermediate transfer belt 230. The second transfer device 52 performs a second transfer (collective transfer) of first transfer images formed on the intermediate transfer belt 230 to a recording medium.

In the exemplary embodiment, the second transfer device 52 includes the second transfer roller 521 which is arranged on the toner image carrying surface side of the intermediate transfer belt 230 under pressure, and a back surface roller (also used as the support roller 232 in this exemplary embodiment) which is arranged on the back surface side of the intermediate transfer belt 230 and which functions as a counter electrode of the second transfer roller 521. For example, the second transfer roller 521 is grounded, and a bias having the same polarity as the charging polarity of the toner is applied to the back surface roller (support roller 232).

The belt cleaning device 53 is further arranged on the upstream of the image forming unit 22*a* which is arranged on the most upstream side of the intermediate transfer belt 230. The belt cleaning device 53 removes the toner remaining on the intermediate transfer belt 230.

The feed roller 61 which feeds a recording medium is disposed on the recording medium supply cassette 24. The transport rollers 62 which feed the recording medium are arranged right behind the feed roller 61. The positioning rollers 63 which supply the recording medium to a second transfer portion at a predetermined timing are arranged on the recording medium transport path 25 which is located right in front of the second transfer portion. The fixing device 66 is arranged on the recording medium transport path 25 located on the downstream of the second transfer portion. The discharge rollers 67 for discharging the recording medium are arranged on the downstream of the fixing device 66. The discharged recording medium is housed in the paper discharge unit 68 formed in an upper portion of the body housing 21.

In the exemplary embodiment, the manual feeder (multi sheet inserter (MSI)) 71 is arranged on a side of the body housing 21. A recording medium on the manual feeder 71 is fed toward the recording medium transport path 25 through the feed rollers 72 and the transport rollers 62.

The double-side recording unit 73 is attached to the body housing 21. When a double-side mode, in which image recording is performed on two surfaces of a recording medium, is selected, the double-side recording unit 73 operates as follows. A recording medium in which recording has been performed on one surface thereof is introduced into the inner portion by reversely rotating the discharge rollers 67 and passing through the guide rollers 74 arranged in front of an inlet. The recording medium in the inner portion is transported through the transporting rollers 77 and along the transport path 76 for returning the recording medium, and supplied again to the positioning roller 63 side.

Next, the cleaning device 34 arranged in the tandem image forming apparatus illustrated in FIG. 3 will be described in detail.

Figure 4:
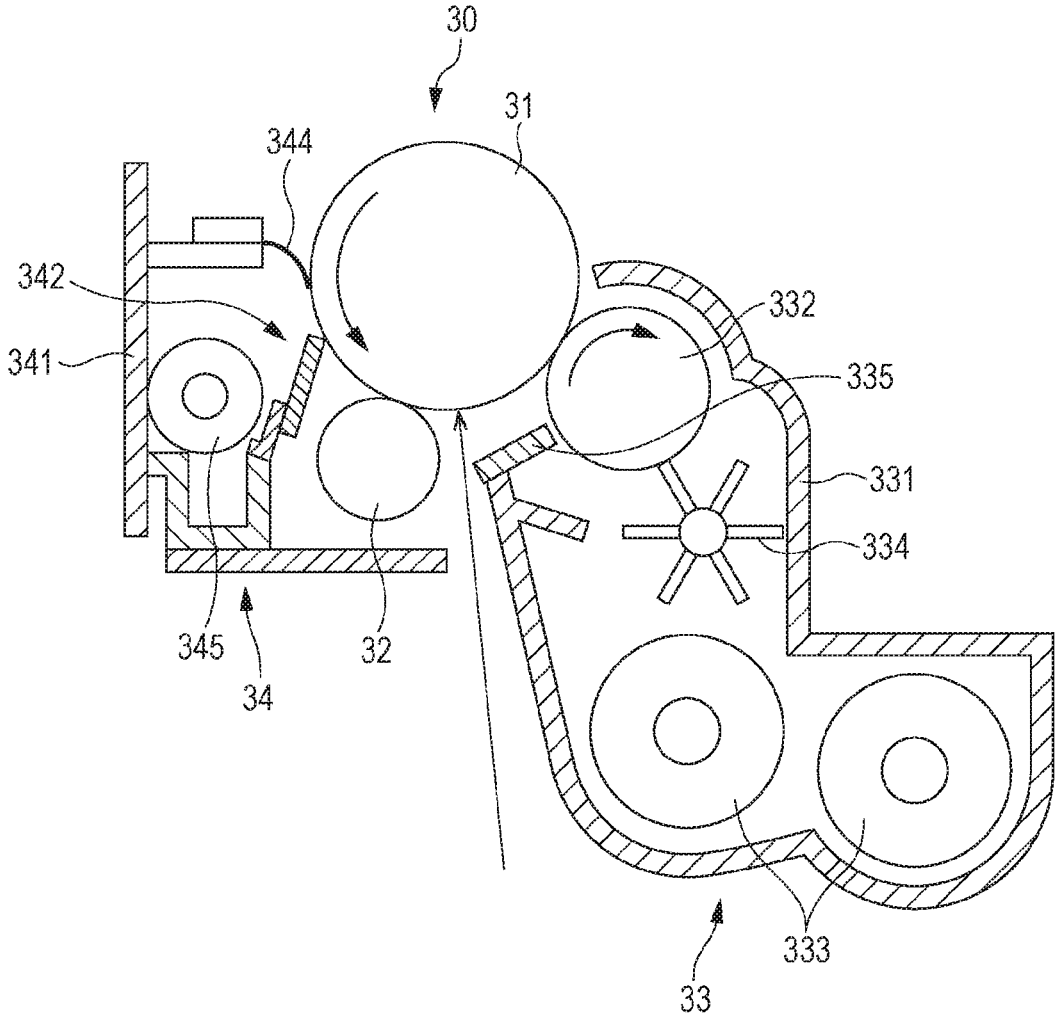
FIG. 4 is a schematic cross-sectional view illustrating an example of a cleaning device according to an exemplary embodiment.

FIG. 4 is a schematic cross-sectional view illustrating an example of the cleaning device of the exemplary embodiment. FIG. 4 also illustrates the photoreceptor drum 31 and the charging roller (charging device) 32 that form a sub-cartridge together with the cleaning device 34 illustrated in FIG. 3, and the developing unit 33.

In FIG. 4, the developing unit 33 includes a unit case 331, a developing roller 332, toner-transporting members 333, a transport paddle 334, and a developer quantity regulating member 335. The cleaning device 34 includes a cleaning case 341, a cleaning blade 342, a film seal 344, and a transport member 345.

The cleaning case 341 of the cleaning device 34 stores a remaining toner and is opened so as to face the photoreceptor drum 31. The cleaning blade 342 that is disposed to be in contact with the photoreceptor drum 31 is attached to a lower edge of the opening of the cleaning case 341 with a bracket (not illustrated) therebetween. The film seal 344 that keeps airtightness between the cleaning case 341 and the photoreceptor drum 31 is attached to an upper edge of the opening of the cleaning case 341. The transport member 345 guides a waste toner stored in the cleaning case 341 to a waste toner container provided on a side face.

In the exemplary embodiment, in all the cleaning devices 34 of respective image forming units 22 (22*a* to 22*d*), the cleaning blade of the exemplary embodiment may be used as the cleaning blade 342. In addition, the cleaning blade of the exemplary embodiment may be used as the cleaning blade 531 in the belt cleaning device 53.

As illustrated in FIG. 4, for example, the developing unit (developing device) 33 used in the exemplary embodiment includes the unit case 331 that stores a developer and is opened so as to face the photoreceptor drum 31. The developing roller 332 is arranged at a position facing the opening of the unit case 331. The toner-transporting members 333 for stirring and transporting the developer are arranged in the unit case 331. Furthermore, the transport paddle 334 may be arranged between the developing roller 332 and the toner-transporting members 333.

In the development, after the developer is supplied to the developing roller 332, the developer is transported to a developing area facing the photoreceptor drum 31 in a state where, for example, a layer thickness of the developer is regulated with the developer quantity regulating member 335.

In the exemplary embodiment, for example, a two-component developer containing a toner and a carrier is used in the developing unit 33. Alternatively, a one-component developer containing only a toner may be used.

Next, the operation of the image forming apparatus according to the present exemplary embodiment will be described. First, the respective image forming units 22 (22*a* to 22*d*) form single-color toner images corresponding to each color. The single-color toner images of each color are sequentially superimposed so as to match with original document information and subjected to a first transfer to a surface of the intermediate transfer belt 230. Subsequently, the color toner images transferred to the surface of the intermediate transfer belt 230 are transferred to a surface of a recording medium by the second transfer device 52. The recording medium to which the color toner images have been transferred is subjected to a fixing treatment by the fixing device 66, and then discharged to the paper discharge unit 68.

In the respective image forming units 22 (22*a* to 22*d*), the toner remaining on the photoreceptor drum 31 is cleaned by the cleaning device 34, and the toner remaining on the intermediate transfer belt 230 is cleaned by the belt cleaning device 53.

In this image forming process, each remaining toner is cleaned by the cleaning device 34 (or the belt cleaning device 53).

In the exemplary embodiment, the cleaning blade 342 is directly fixed to a frame member in the cleaning device 34 as illustrated in FIG. 4. Alternatively, the cleaning blade 342 may be fixed to a frame member with a spring material therebetween.

EXAMPLES

The invention will now be described using Examples. However, the invention is not limited to the Examples. In the description below, the term "part" means "part by weight".

Example 1

Preparation of Cleaning Blade A1

A polycaprolactone polyol (manufactured by Daicel Corporation, PLACCEL 205, average molecular weight 529, hydroxyl value 212 KOHmg/g), a polycaprolactone polyol (manufactured by Daicel Corporation, PLACCEL 240, average molecular weight 4,155, hydroxyl value 27 KOHmg/g), and an adipic acid polyol (manufactured by Hitachi Chemical Co., Ltd., TESURAKKU 2464, average molecular weight 1,000, hydroxyl value 110 to 120 KOHmg/g) are used as a soft segment material of a polyol component in a ratio of PLACCEL 205:PLACCEL 240:TESURAKKU 2464=3:2:5 (weight ratio). An acrylic resin having two or more hydroxyl groups (manufactured by Soken Chemical & Engineering Co., Ltd., ACTFLOW UMB-2005B) is used as a hard segment material. The soft segment material and the hard segment material are mixed in a ratio of 8:2 (weight ratio).

Next, 6.26 parts of 4,4'-diphenylmethane diisocyanate (manufactured by Tosoh Corporation, Millionate MT) is added as an isocyanate compound relative to 100 parts by weight of the mixture (polyol mixture) of the soft segment material and the hard segment material. The resulting mixture is allowed to react in a nitrogen atmosphere at 70° C. for three hours. The amount of the isocyanate compound used in this reaction is selected so that the ratio of isocyanate groups to hydroxyl groups contained in the reaction system (isocyanate group/hydroxyl group) becomes 0.5.

Subsequently, 34.3 parts of the isocyanate compound is further added thereto, and the resulting mixture is allowed to react in a nitrogen atmosphere at 70° C. for three hours to obtain a prepolymer. The total amount of the isocyanate compound used in the preparation of the prepolymer is 40.56 parts.

Next, the temperature of this prepolymer is increased to 100° C., and the prepolymer is defoamed under reduced pressure for one hour. Subsequently, 7.14 parts of a mixture of 1,4-butanediol (chain-extending agent) and trimethylolpropane (crosslinking agent) (weight ratio=60/40) is added relative to 100 parts of the prepolymer, and mixed for three minutes so as not to entrain bubbles. Thus, a composition A1 for forming a blade is prepared.

The composition A1 for forming a blade contains 66.4% by weight of the polyol mixture, 4.0% by weight of the chain-extending agent, 26.9% by weight of the isocyanate compound, and 2.7% by weight of the crosslinking agent.

Next, the composition A1 for forming a blade is poured into a centrifugal molding machine including a mold whose temperature is adjusted to 140° C., and subjected to a curing reaction for one hour. Subsequently, the composition A1 is aged by heating at 110° C. for 24 hours and cooled. The resulting composition A1 is then cut to prepare a cleaning blade A1 having a length of 320 mm, a width of 12 mm, and a thickness of 2 mm.

Example 2

Preparation of Cleaning Blade A2

A cleaning blade is prepared under the same conditions as those in Example 1 except that, in Example 1, the polyol mixture is changed to polytetramethylene ether glycol (PTG-2000SN manufactured by Hodogaya Chemical Co., Ltd.) and the total composition is changed so that the ratio of the polyol is 87.4% by weight, the ratio of the chain-extending agent is 4.1% by weight, the ratio of the isocyanate compound is 7.8% by weight, and the ratio of the crosslinking agent is 0.7% by weight.

Example 3

Preparation of Cleaning Blade A3

A cleaning blade is prepared under the same conditions as those in Example 1 except that, in Example 1, the polyol mixture is changed to a prepolymer obtained by prepolymerization of adipic acid and sebacic acid in a ratio of 15:9 (molar ratio) and the total composition is changed so that the ratio of the prepolymer is 78% by weight, the ratio of the chain-extending agent is 6% by weight, the ratio of the isocyanate compound is 15.1% by weight, and the ratio of the crosslinking agent is 0.9% by weight.

Example 4

Preparation of Cleaning Blade A4

A cleaning blade is prepared under the same conditions as those in Example 1 except that, in Example 1, the polyol mixture is changed to polytetramethylene ether glycol (PTG-2000SN manufactured by Hodogaya Chemical Co., Ltd.) and the total composition is changed so that the ratio of the polyol is 83.3% by weight, the ratio of the chain-extending agent is 4.7% by weight, the ratio of the isocyanate compound is 11.1% by weight, and the ratio of the crosslinking agent is 0.9% by weight.

Comparative Example 1

Preparation of Cleaning Blade B1

A cleaning blade is prepared under the same conditions as those in Example 1 except that, in Example 1, the polyol mixture is changed to polytetramethylene ether glycol (PTG-2000SN manufactured by Hodogaya Chemical Co., Ltd.) and the total composition is changed so that the ratio of the polyol is 88% by weight, the ratio of the chain-extending agent is 4.1% by weight, the ratio of the isocyanate compound is 7.2% by weight, and the ratio of the crosslinking agent is 0.7% by weight.

Comparative Example 2

Preparation of Cleaning Blade B2

A cleaning blade is prepared under the same conditions as those in Example 1 except that, in Example 1, the polyol mixture is changed to a prepolymer obtained by prepolymerization of adipic acid and 1,9-nonanediol in a ratio of 1:1 (molar ratio) and the total composition is changed so that the ratio of the prepolymer is 52.3% by weight, the ratio of the chain-extending agent is 25.4% by weight, the ratio of the isocyanate compound is 21.6% by weight, and the ratio of the crosslinking agent is 0.7% by weight.

Comparative Example 3

Preparation of Cleaning Blade B3

A cleaning blade is prepared under the same conditions as those in Example 1 except that, in Example 1, the polyol mixture is changed to a prepolymer obtained by prepolymerization of adipic acid and polycaprolactone (manufactured by Daicel Corporation, product name: PLACCEL 205, average molecular weight 529) in a ratio of 2:3 (molar ratio) and the total composition is changed so that the ratio of the prepolymer is 50.1% by weight, the ratio of the chain-extending agent is 33.4% by weight, the ratio of the isocyanate compound is 15.7% by weight, and the ratio of the crosslinking agent is 0.8% by weight.

Evaluation Test: Shape-Retaining Property Evaluation

An amount of shape deformation is measured by a method described below to evaluate a shape-retaining property.

The cleaning blade obtained in each of Examples and Comparative Examples is pressed onto a photoreceptor with a free length FL (a length of a region that is not supported by a supporting member, so-called blade free length) of 8.2 mm, at a pressing force NF (normal force) of 2.60 gf/mm, and at a pressing angle W/A (working angle) of 11.5° to assemble a process cartridge. The process cartridge is stored in a high-temperature high-humidity environment (50° C., 95% RH) for 72 hours in a state of laminated packing (in a state where the process cartridge is hermetically sealed in an airtight bag). An amount of deformation in an end of an edge (contact corner portion) after storage is measured with a microscope (manufactured by Keyence Corporation, laser microscope VK-8510).

The amount of shape deformation is determined as an absolute value of the difference from the state before storage. The smaller the amount of shape deformation, the better the shape-retaining property. The evaluation criteria are shown below.

TABLE 1

| Shape-retaining property evaluation criteria | Amount of shape deformation | Defective cleaning |
|---|---|---|
| C0 | Less than 1.0 μm | Not occur |
| C1 | 1.0 μm or more and less than 2.0 μm | Not occur |
| C2 | 2.0 μm or more and less than 3.0 μm | Not occur |
| C3 | 3.0 μm or more and less than 4.0 μm | Occur |
| C4 | 4.0 μm or more and less than 5.0 μm | Occur |
| C5 | 5.0 μm or more | Occur |

Evaluation Test: Edge Chipping Evaluation

The degree of the occurrence of chipping is evaluated by a method described below. The cleaning blade obtained in each of Examples and Comparative Examples is mounted on a DocuCentre-IV C5575 image forming apparatus manufactured by Fuji Xerox Co., Ltd. The pressing force NF (normal force) is adjusted to 1.3 gf/mm, the pressing angle W/A (working angle) is adjusted to 11°, and printing is then performed on 10K (10,000) sheets.

The degree of the occurrence of chipping is evaluated in accordance with the criteria described below on the basis of the size of chipping and the number of chippings generated at that time. The degree of the occurrence of chipping is measured in a range of 100 mm of a central portion in the axial direction.

TABLE 2

| Edge chipping evaluation criteria | Edge chipping | Defective cleaning |
|---|---|---|
| C1 | Chipping does not occur | Not occur |
| C2 | Chipping size: 1 μm or less<br>Number: 1 or more and less than 5 | Not occur |

TABLE 2-continued

| Edge chipping evaluation criteria | Edge chipping | Defective cleaning |
|---|---|---|
| C3 | Chipping size: 1 μm or less<br>Number: 5 or more and less than 10 | Not occur |
| C4 | Chipping size: 1 μm or less<br>Number: 10 or more | Not occur |
| C5 | Chipping size: More than 1 μm and 5 μm or less<br>Number: 1 or more and less than 5 | Not occur |
| C6 | Chipping size: More than 1 μm and 5 μm or less<br>Number: 5 or more and less than 10 | Occur |
| C7 | Chipping size: More than 1 μm and 5 μm or less<br>Number: 10 or more | Occur |
| C8 | Chipping size: More than 5 μm<br>Number: 1 or more and less than 5 | Occur |
| C9 | Chipping size: More than 5 μm<br>Number: 5 or more and less than 10 | Occur |
| C10 | Chipping size: More than 5 μm<br>Number: 10 or more | Occur |

Evaluation Test: Edge Abrasion Evaluation

In the evaluation of edge abrasion, the cleaning blade obtained in each of Examples and Comparative Examples is mounted on a DocuCentre-IV C5575 image forming apparatus manufactured by Fuji Xerox Co., Ltd. The pressing force NF (normal force) is adjusted to 1.3 gf/mm, and the pressing angle W/A (working angle) is adjusted to 11°. An image is formed on A4 sheets (210×297 mm, P paper, manufactured by Fuji Xerox Co., Ltd.) in a high-temperature high-humidity environment (28° C., 85% RH) until the cumulative number of rotations of the photoreceptor becomes 100K cycles (100,000 rotations). After the image formation, abrasion of an end of an edge of the cleaning blade and defective cleaning are evaluated in combination, and edge abrasion is thus determined.

In this test, an image density of the image to be formed is set to 1% so that the evaluation is performed under a severe condition in which a lubricating effect in the contact portion between the photoreceptor and the cleaning blade is reduced.

Subsequently, an abrasion depth of the end of the edge after the test is determined from a maximum depth of an edge-missing portion of the cleaning blade on the photoreceptor surface side, the maximum depth being measured when the cleaning blade is observed from the cross-sectional side thereof with a laser microscope VK-8510 manufactured by Keyence Corporation. The defective cleaning is evaluated as follows. After the completion of the above test, an A3 sheet having an untransferred solid image (solid image size: 400 mm×290 mm) thereon is supplied between the photoreceptor and the cleaning blade at an ordinary process speed. The image forming apparatus is stopped immediately after a rear end of the unfixed image in the transporting direction passes through a portion in which the photoreceptor comes in contact with the cleaning blade, and slipping through of the toner is visually observed. When slipping through of the toner is significantly observed, it is determined that defective cleaning occurs. In the case where a portion for holding the toner is lost by abrasion or chipping of the end of the edge, the larger the abrasion depth or the chipping depth of the edge, the more easily defective cleaning occurs in the test described above. Accordingly, the above test is useful for a qualitative evaluation of abrasion or chipping of the end of the edge.

The evaluation criteria of the edge abrasion are described below. The acceptable ranges are C0 to C2.

TABLE 3

| Edge abrasion evaluation criteria | Edge abrasion depth | Defective cleaning |
|---|---|---|
| C0 | 3 μm or less No abrasion trace | Not occur |
| C1 | 3 μm or less | Not occur |
| C2 | More than 3 μm and 5 μm or less | Not occur |
| C3 | More than 3 μm and 5 μm or less | Occur |
| C4 | More than 5 μm and 10 μm or less | Occur |
| C5 | More than 10 μm | Occur |

Comprehensive Evaluation

A comprehensive evaluation is performed on the basis of the following criteria.

A: All the following conditions are satisfied. The result of the shape-retaining property evaluation is in the range of C0 to C2. The result of the edge chipping evaluation is C1 or C2. The result of the edge abrasion evaluation is C0 or C1.

B: At least one of the following conditions is satisfied. The result of the shape-retaining property evaluation is C3. The result of the edge chipping evaluation is in the range of C3 to C5. The result of the edge abrasion evaluation is C2. In addition, the results do not correspond to a criterion C described below.

C: At least one of the following conditions is satisfied. The result of the shape-retaining property evaluation is C4 or C5. The result of the edge chipping evaluation is in the range of C6 to C10. The result of the edge abrasion evaluation is in the range of C3 to C5.

TABLE 4

| | Example 1 | Example 2 | Example 3 | Example 4 | Comparative Example 1 | Comparative Example 2 | Comparative Example 3 |
|---|---|---|---|---|---|---|---|
| Peak intensity ratio (A/B) | 1.1 | 1.12 | 1.24 | 1.28 | 1 | 0.998 | 0.96 |
| tanδ peak temperature [° C.] | 5 | −10 | −27 | −44 | 0 | −5 | 1 |
| Amount of shape deformation [μm] | 2.3 | 2.2 | 1.3 | 1.8 | 2.8 | 6.3 | 3.16 |
| Shape-retaining property evaluation | C2 | C2 | C1 | C1 | C2 | C5 | C3 |
| Edge chipping evaluation | C4 | C2 | C1 | C1 | C8 | C3 | C4 |
| Edge abrasion evaluation | C2 | C1 | C1 | C1 | C3 | C5 | C4 |
| Comprehensive evaluation | B | A | A | A | C | C | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning blade comprising:

a polyurethane member that contains a polyurethane, the polyurethane member constituting at least a contact portion that comes in contact with a member to be cleaned, wherein an infrared absorption spectrum obtained by infrared spectroscopy of the polyurethane member has a peak intensity ratio (A/B) of about 1.1 or more, where A represents an intensity of a spectral peak due to a carbonyl group that does not form a hydrogen bond, the spectral peak appearing in a range of about 1,730 $cm^{-1}$ or more and about 1,740 $cm^{-1}$ or less, and B represents an intensity of a spectral peak due to a carbonyl group that forms a hydrogen bond, the spectral peak appearing in a range of about 1,670 $cm^{-1}$ or more and about 1,720 $cm^{-1}$ or less.

2. The cleaning blade according to claim 1, wherein the peak intensity ratio (A/B) is about 1.15 or more.

3. The cleaning blade according to claim 1, wherein the peak intensity ratio (A/B) is about 1.2 or more.

4. The cleaning blade according to claim 1, wherein the peak intensity ratio (A/B) is about 1.3 or less.

5. The cleaning blade according to claim 1, wherein the polyurethane member has a tan δ peak temperature of about 5° C. or less.

6. The cleaning blade according to claim 5, wherein the polyurethane member has a tan δ peak temperature of about −30° C. or more.

7. The cleaning blade according to claim 1, wherein the polyurethane member has a tan δ peak temperature of about −25° C. or more and about 2° C. or less.

8. The cleaning blade according to claim 1, wherein the polyurethane member has a tan δ peak temperature of about −20° C. or more and about 0° C. or less.

9. A process cartridge detachably attachable to an image forming apparatus, the process cartridge comprising:

a cleaning device that includes the cleaning blade according to claim 1.

10. An image forming apparatus comprising:

an image-carrying member;

a charging device that charges a surface of the image-carrying member;

an electrostatic latent image-forming device that forms an electrostatic latent image on the surface of the image-carrying member in a charged state;

a developing device that develops the electrostatic latent image formed on the surface of the image-carrying member with a developer containing a toner to form a toner image;

a transfer device that transfers the toner image to a surface of a recording medium; and a cleaning device that includes the cleaning blade according to claim 1 and that cleans the surface of the image-carrying member by bringing the cleaning blade into contact with the image-carrying member.

* * * * *